US006586986B2

(12) United States Patent
Kang

(10) Patent No.: US 6,586,986 B2
(45) Date of Patent: Jul. 1, 2003

(54) CIRCUIT FOR GENERATING INTERNAL POWER VOLTAGE IN A SEMICONDUCTOR DEVICE

(75) Inventor: Dong Keum Kang, Chungcheongbuk-do (KR)

(73) Assignee: Hynix Semiconductor Inc., Kyoungki-do (KR)

( * ) Notice: Subject to any disclaimer, the term of this patent is extended or adjusted under 35 U.S.C. 154(b) by 0 days.

(21) Appl. No.: 10/054,340

(22) Filed: Nov. 13, 2001

(65) Prior Publication Data

US 2002/0079955 A1 Jun. 27, 2002

(30) Foreign Application Priority Data

Dec. 27, 2000 (KR) ..... 2000-83136

(51) Int. Cl.[7] ..... G05F 1/10

(52) U.S. Cl. ..... 327/540; 327/541; 327/545; 327/546; 326/87

(58) Field of Search ..... 327/540, 541, 327/544, 545, 546, 112; 323/313, 314; 326/34, 81, 85, 86, 87

(56) References Cited

U.S. PATENT DOCUMENTS

| | | | | |
|---|---|---|---|---|
| 4,451,908 A | | 5/1984 | Takemae et al. | 365/222 |
| 5,136,260 A | * | 8/1992 | Yousefi-Elezei | 331/17 |
| 5,349,559 A | * | 9/1994 | Park et al. | 365/201 |
| 5,424,690 A | * | 6/1995 | Ohno | 331/57 |
| 5,504,452 A | * | 4/1996 | Takenaka | 327/541 |
| 5,557,571 A | | 9/1996 | Kato | 365/189.05 |
| 5,583,457 A | * | 12/1996 | Horiguchi et al. | 326/121 |
| 5,710,741 A | | 1/1998 | McLaury | 365/226 |
| 5,717,354 A | | 2/1998 | Kim et al. | 327/309 |
| 5,912,855 A | | 6/1999 | McLaury | 365/226 |
| 6,101,142 A | | 8/2000 | McLaury | 365/226 |

FOREIGN PATENT DOCUMENTS

| | | |
|---|---|---|
| JP | 232870 | 8/1999 |
| JP | 029551 | 1/2000 |
| JP | 0243081 | 9/2000 |

* cited by examiner

*Primary Examiner*—Timothy P. Callahan
*Assistant Examiner*—An T. Luu
(74) *Attorney, Agent, or Firm*—Ladas & Parry

(57) ABSTRACT

A circuit for generating internal power voltage comprising: a comparison unit for comparing reference voltage and internal voltage; a buffer unit, its input terminal comprising CMOS inverters, for buffering an output signal of the comparison unit; a buffer control unit for controlling current flowing through the CMOS inverters of the buffer unit less than a predetermined amount in regular operations and for controlling current flowing through the CMOS inverters of the buffer unit more than a predetermined amount in active operation; a first current supply unit for supplying current according to an output signal of the buffer unit; and a load unit for generating internal voltage by current supply from the first current supply unit.

11 Claims, 2 Drawing Sheets

CIRCUIT FOR GENERATING INTERNAL POWER VOLTAGE IN A SEMICONDUCTOR DEVICE

BACKGROUND OF THE INVENTION

1. Field of the Invention

The present invention relates generally to a circuit for generating internal power voltage in a semiconductor device, and more particularly to, a circuit for stably generating internal power voltage as low consumption power in a semiconductor device having a CMOS inverter.

2. Description of the Related Art

FIG. 1 is a diagram of a conventional circuit for generating internal power voltage. As shown in FIG. 1, the conventional circuit for generating internal power voltage comprises: a comparison unit 11 for comparing reference voltage, Vref, and internal voltage, Vint; a first current supply unit 12 for supplying external voltage Vext to internal voltage Vint according to an output signal from the comparison unit 11; a buffer unit 13 for buffering the output signal from the comparison unit 11 and for outputting the result; a second current supply unit 14 for supplying external voltage Vext to internal voltage Vint according to the output signal from the buffer unit 13; and a load circuit unit 15 connected between the internal voltage Vint and ground voltage, Vss.

Here, the first current supply unit 12 and the second current supply unit 14 comprise PMOS transistors and the buffer unit 13 comprises two inverter circuits connected in series. The comparison unit 11 comprises difference amplifiers having a current mirror structure for comparing and amplifying reference voltage Vref and internal voltage Vint. The comparison unit 11 inputs reference voltage Vref as an inverting (−) signal and internal voltage Vint as a noninverting (+) signal and then compares their voltage levels to output the resultant signal to node Nd2. The first current supply unit 12 supplies current to the load circuit 15 according to the output signal from the comparison unit 11 so that the internal voltage Vint may reach a desired value.

In operation, when internal voltage Vint is lower than the reference voltage Vref, the output node Nd2 of the comparison unit 11 achieves a 'low' signal level, thereby turning on a PMOS transistor P1 of the first current supply unit 12 and thereby supplying electric current to the load circuit unit 15. The 'low' signal of output node Nd2 of the comparison unit 11 is buffered through buffer unit 13, thereby turning on a PMOS transistor P2 of the second current supply unit 14 and thereby supplying electric current to load circuit unit 15.

When internal voltage Vint is higher than the reference voltage Vref, output node Nd2 of the comparison unit 11 achieves a 'high' signal level, thereby turning off the PMOS transistor P1 of the first current supply unit 12. A 'high' signal of the output node Nd2 turns off the PMOS transistor P2 of the second current supply unit 14 through the buffer unit 13, thereby preventing supply of electric current to load circuit unit 15.

However, the conventional circuit for generating internal power voltage has several drawbacks. For example, in active operation, many current paths are generated in the buffer unit 13, comprising inverter circuits, since the output signal of the comparison unit 11 is not a digital signal but an analogue signal. As a result, current consumption is increased. Further, when the signal of output node Nd2 from the comparison unit 11 has an unstable level, a problem arises in that the inverter circuits of the buffer unit 13 do not operate effectively. Here, active operations are operation modes requiring prompt response speed, such as memory read and write in a semiconductor memory device, and regular operations are operation modes in which memory is turned on, such as in a standby state.

SUMMARY OF THE INVENTION

Therefore, the present invention has been made to solve the above problems and an object of the invention is to provide a circuit for generating an internal power voltage capable of reducing consumption power and improving response speed.

In order to achieve the above object, the present invention comprises: a comparison unit for comparing reference voltage and internal voltage; a buffer unit, its input terminal comprising a CMOS inverter, for buffering the output signal of the comparison unit; a buffer control unit for controlling current flowing through the CMOS inverters of the buffer unit within a predetermined amount during regular operation and for controlling current flowing through the CMOS inverters of the buffer unit over the predetermined amount for a restricted time during active operation; a first current supply unit for supplying current according to the output signal of the buffer unit; and a load unit for generating internal voltage by current supplied from the first current supply unit.

It is desirable that a second current supply unit is included in the above structure to supply current to the load unit according to the output signal of the comparison unit. The CMOS inverter of buffer unit comprises PMOS and NMOS supplied with the output signal of the comparison unit through a common gate and obtaining output from a common drain wherein a first PMOS and a second PMOS are connected to the PMOS source of the CMOS inverter and a first NMOS and a second NMOS are connected to the NMOS source of the CMOS inverter. The buffer control unit comprises a constant voltage generating means for supplying constant voltage to gates of the first PMOS and the first NMOS in regular operations of the semiconductor device and a pulse generating means for supplying pulse signals of a predetermined width to gates of the second PMOS and the second NMOS in active operations of the semiconductor device. Here, the semiconductor device is a semiconductor memory device and regular operation indicates the case wherein the semiconductor memory device is turned on and active operation indicates the case wherein read or write operations are performed.

According to the present invention, a circuit for generating internal power voltage of a semiconductor device comprises: a comparison unit for comparing reference voltage Vref and internal voltage Vint; a first current supply unit for supplying external voltage Vext to the internal voltage according to the output signal of the comparison unit; a buffer unit for buffering the output signal of the comparison unit and for outputting the result; a pulse generation unit for increasing the current driving force of the buffer unit during a predetermined time during active operation; a gate bias unit for transforming voltage source supplied to the buffer unit into constant voltage source during other operations; a second current supply unit for supplying the external voltage to internal voltage according to output signal of the buffer unit; and a load circuit unit, connected between the internal voltage and ground voltage, for consuming the internal voltage.

According to the present invention with features as described above, the buffer control unit controls a current flowing through the CMOS inverters of the buffer unit when the voltage is less than a predetermined amount in regular operations. In active operation, the buffer control unit controls the current flowing through the CMOS inverters of the buffer unit when the voltage is more than the predetermined amount and lasts for a predetermined time interval. Therefore, not only is power consumption reduced, both also response speed is shortened when the present invention is used.

DETAILED DESCRIPTION OF THE DRAWINGS

The above objects, and other features and advantages of the present invention, will become more apparent after reading the following detailed description when taken in conjunction with the accompanying drawings. In the following description and all drawings, those parts having the same function will be designated by the same numerals, and so repetition of the description on the same parts will be omitted.

Figure 1:
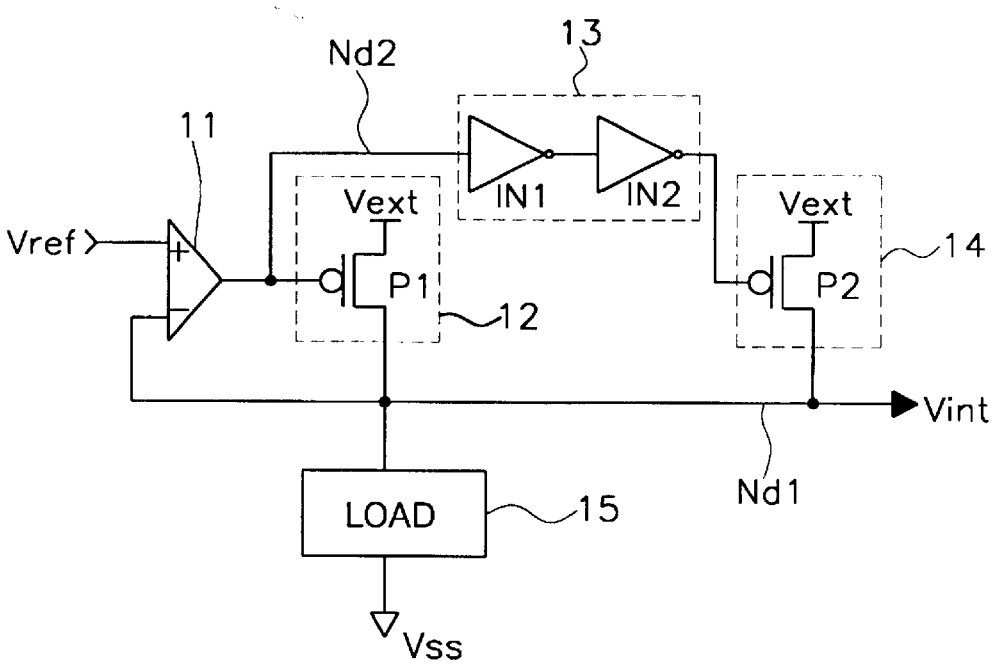
FIG. 1 (PRIOR ART)
FIG. 1 is a diagram of a conventional circuit for generating internal power voltage.
Figure 2:
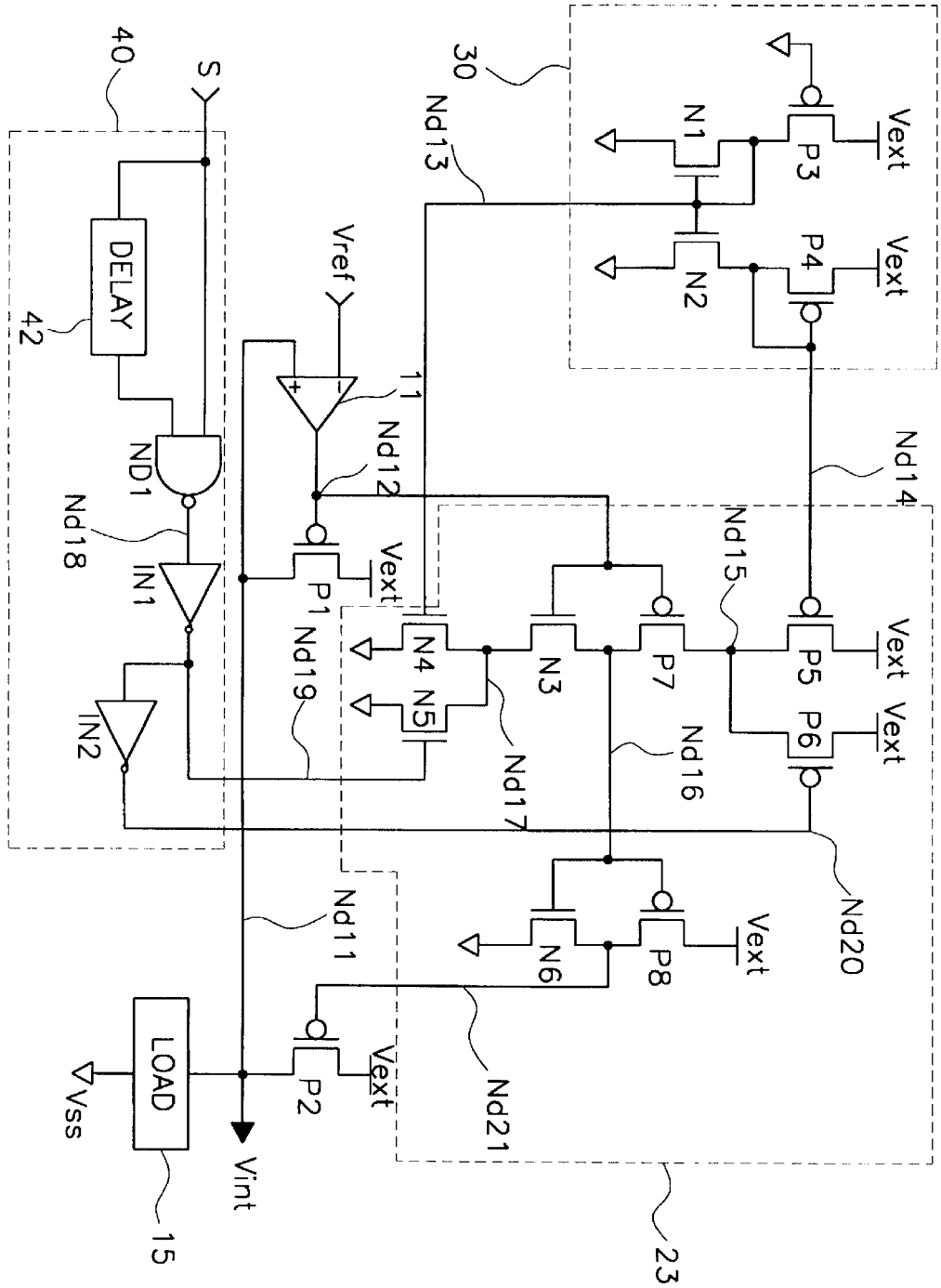
FIG. 2 is a diagram of a circuit for generating internal power voltage according to the present invention.

FIG. 2 is a diagram of a circuit for generating internal power voltage according to the present invention. As shown in FIG. 2, the circuit for generating internal power voltage of the present invention comprises: a comparison unit 11 for comparing reference voltage, Vref, and internal voltage, Vint; a first current supply unit P1 for supplying external voltage, Vext, to internal voltage Vint according to the output signal of the comparison unit 11; a buffer unit 23 for buffering the output signal of the comparison unit 11 and for outputting the result; a pulse generation unit 40 for increasing the current driving force of the buffer unit 23 during a predetermined time during active operation; a gate bias unit 30 for transforming the voltage source supplied to the buffer unit 23 into a constant voltage source during other operations; a second current supply unit P2 for supplying the external voltage to the internal voltage according to the output signal of the buffer unit 23; and a load circuit unit 15, connected between the internal voltage Vint and a ground voltage, Vss, for consuming the internal voltage. The pulse generation unit 40 and the gate bias unit (that is, the constant voltage generating means) 30 form a buffer control unit.

The first current supply unit P1 and the second current supply unit P2 include a PMOS performing operation of the current supply unit and the load circuits. The buffer unit 23 comprises two inverter circuits connected in series. The number of inverters can be changed as needed. The comparison unit 11 comprises difference amplifiers having a current mirror structure for comparing and amplifying the reference voltage Vref and the internal voltage Vint. The comparison unit 11 inputs the reference voltage Vref as an inverting (−) signal and the internal voltage Vint as a noninverting (+) signal and then compares their signal levels to output the resultant signal to node Nd2. The first current supply unit P1 supplies current to the load circuit 15 according to the output signal from the comparison unit 11 so that the internal voltage Vint may reach a desired value. The second current supply unit P2 supplies current to the load circuit 15 according to the output signal from the buffer unit 23 so that the internal voltage Vint may reach a desired value.

The buffer unit 23 comprises a first inverter unit including: a PMOS transistor P7 for transmitting the voltage of node Nd15 to node Nd16 according to the output signal Nd12 of the comparison unit 11; a NMOS transistor N3 for discharging the signal of the node Nd16 to node Nd17 according to the output signal Nd12 of the comparison unit 11; a PMOS transistor P5 for regularly supplying external voltage Vext to the node Nd15 according to the output signal Nd14 of the gate bias unit 30; a PMOS transistor P6 for supplying external voltage Vext to the node Nd15 according to the output signal Nd20 of the pulse generation unit 40; a NMOS transistor N3 for discharging the signal of the node Nd16 to node Nd17 according to the output signal of the comparison unit 11; a NMOS transistor N4 for regularly discharging the signal of the node Nd17 to ground voltage Vss according to the output signal Nd13 of the gate bias unit 30; and a NMOS transistor N5 for discharging the signal of the node Nd17 to ground voltage according to the output signal Nd19 of the pulse generation unit 40 and a second inverter unit, including a PMOS transistor P8, for outputting the external voltage to node Nd21 according to the signal of the node Nd16 and a NMOS transistor N6 for discharging the signal of the node Nd21 to ground voltage according to the signal of the node Nd16.

The gate bias unit 30 comprises: a PMOS transistor P3 connected in a diode structure between the external voltage Vext and node Nd13 connected to gate of the NMOS transistor N4 of the buffer unit 23; a NMOS transistor N1 for discharging voltage of the node Nd13 to ground voltage according to the voltage of the node Nd13; a PMOS transistor P4 for transmitting external voltage to the node Nd14 and node Nd14 connected to the gate of the PMOS transistor P5; and a NMOS transistor N2 for discharging the voltage of the node Nd14 to ground voltage according to voltage of the node Nd14.

The pulse generation unit 40 comprises: a NAND gate ND1 for inputting an active operation signal S and a delay signal of the active operation signal S arising from a delay circuit 42 and for generating a pulse signal in a predetermined area; an inverter IN1 for inverting the signal of the node Nd18 and for outputting the result to node Nd19 connected to gate of the NMOS transistor N5 of the buffer unit 23 and to an inverter IN2; and the inverter IN2 for inverting the signal of the node Nd19 and for outputting the result to node Nd20 connected to gate of the PMOS transistor P6 of the buffer unit 23.

The operation of the inventive circuit for generating internal power voltage will be described below. First, when internal voltage Vint is lower than reference voltage Vref, the output signal Nd12 of the comparison unit 11 achieves an analogue 'low' level, thereby turning on the first current supply unit P1 in other operations, except in active operation, and supplying current to the load circuit unit 15. During active operation, the active operation signal S achieves a 'high' level, thereby generating a pulse signal having a 'high' level in a predetermined area to output nodes Nd19, Nd20 of the pulse generation unit 40 comprising the delay circuits 42. Therefore, the PMOS transistor P6 and NMOS transistor N5 of the buffer unit 23 are driven by the signals of the output nodes Nd19, Nd20, thereby increasing driving force of the inverters. Since the output node Nd12 of the comparison unit 11 is at a 'low' signal value, the output node Nd16 of the inverters P7, N3 is set at a full swing 'high' value and node Nd21 is set at a full swing 'low' value by inverters P8, N6. The second current supply unit P2 is driven by a signal 'low' value of the node Nd21, thereby supplying current to the load circuit unit 15. Here, the PMOS transistor P5 and the NMOS transistor N4 of the buffer unit 23 are longer than the PMOS transistor P6 and the NMOS transistor N5 in order to reduce consumption power in other operations except during active operation.

In active operation, the PMOS transistor P6 and NMOS transistor N5 are controlled by output signals Nd19, Nd20 of the pulse generation unit 40 in order to increase response speed. A constant current source is supplied to the buffer unit 23 regularly without regard to the external voltage by using the output signal of the gate bias unit 30. If internal voltage Vint is higher than reference voltage Vref, the output signal Nd12 of the comparison unit 11 becomes an analogue 'high' level. In operations other than active, the first current supply unit P1 is turned off, thereby preventing current supply to the load circuit unit 15. During active operation, if the active operation signal S achieves a 'high' value, the node Nd21 is set in a full swing 'high' value, thereby turning off the second current supply unit P2 and preventing current supply to the load circuit unit 15 although output signal Nd19, Nd20 is generated in pulse generation unit 40 comprising delay circuits.

As described above, the present invention is generally applied to a semiconductor memory device. Moreover, it is also possible to apply the teachings of this invention to any other semiconductor devices required to generate internal power voltage. Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A circuit in a semiconductor device for generating internal power voltage comprising:

a comparison unit for comparing reference voltage and internal voltage;

a buffer unit comprising a CMOS inverter for buffering the output signal of the comparison unit;

a buffer control unit for controlling power consumption and response speed of the circuit by controlling the current flowing through a foremost CMOS inverter in the buffer unit during a regular operation and also by controlling the current flowing through the foremost CMOS inverter during an active operation;

a gate bias unit for supplying a constant voltage source to the buffer unit in operations other than the active operation;

a first current supply unit for supplying current according to the output signal of the buffer unit;

a second current supply unit for supplying current to the load unit according to the output signal of the comparison unit; and a load unit for generating internal voltage by drawing on the current from at least one of the first and second current supply units.

2. The circuit in a semiconductor device for generating internal power voltage according to claim 1, wherein the semiconductor device is a semiconductor memory device and the regular operation comprises the semiconductor memory device being turned on and the active operation comprises a condition wherein write and read operations are being performed in the semiconductor memory device.

3. The circuit for generating internal power voltage comprising:

a comparison unit for comparing a reference voltage and an internal voltage;

a first current supply unit for supplying external voltage to the internal voltage according to an output signal of the comparison unit;

a buffer unit for buffering the output signal of the comparison unit and for outputting the result;

a pulse generation unit for increasing the current driving force of the buffer unit for a predetermined time during active operation;

a gate bias unit for transforming the voltage source supplied to the buffer unit into a constant voltage source in operations other than active operation;

a second current supply unit for supplying the external voltage to the internal voltage according to the output signal of the buffer unit; and a load circuit unit, connected between the internal voltage and ground voltage, for consuming the internal voltage.

4. The circuit for generating internal power voltage according to claim 3, wherein the comparison unit comprises plural difference amplifiers having a current mirror structure.

5. The circuit for generating internal power voltage according to claim 3, wherein the first current supply unit further comprises a PMOS transistor.

6. The circuit for generating internal power voltage according to claim 3, wherein the second current supply unit further comprises a PMOS transistor.

7. The circuit for generating internal power voltage according to claim 3, wherein the buffer unit further comprises a first inverter unit and a second inverter unit and the first inverter unit comprises:

a first PMOS transistor for transmitting external voltage to a first node according to the output signal of the comparison unit;

a first NMOS transistor for discharging the signal of the first node to a second node according to the output signal of the comparison unit;

a second PMOS transistor for regularly supplying external voltage to the source terminal of the first PMOS transistor according to the output signal of the gate bias unit;

a third PMOS transistor for supplying external voltage to the source terminal of the first PMOS transistor according to the output signal of the pulse generation unit;

a second NMOS transistor for discharging a signal of the second node to ground voltage according to the output signal of the gate bias unit; and a third NMOS transistor for discharging a signal of the second node to ground voltage according to the output signal of the pulse generation unit and the second inverter unit comprises a fourth PMOS transistor for outputting external voltage to the third node according to the signal of the first node and a fourth NMOS transistor for discharging signal of the third node to ground voltage according to signal of the first node.

8. The circuit for generating internal power voltage according to claim 7, wherein the gate bias unit further comprises:

a fifth PMOS transistor connected in a diode structure between the external voltage and a fourth node connected to the gate of the second NMOS transistor;

a fifth NMOS transistor for discharging voltage of the fourth node to ground voltage according to voltage of the fourth node;

a sixth PMOS transistor for transmitting external voltage to a fifth node by the fifth node being connected to gate of the second PMOS transistor; and a sixth NMOS transistor for discharging voltage of the fifth node to ground voltage according to the voltage of the fourth node.

9. The circuit for generating internal power voltage according the claim 7, wherein the gate bias unit further comprises:

a fifth PMOS transistor connected in a diode structure between the external voltage and a fourth node connected to the gate of a second NMOS transistor;

a fifth NMOS transistor for discharging voltage of the fourth node to ground voltage according to voltage of the fourth node;

a sixth PMOS transistor for transmitting external voltage to a fifth node by the fifth node being connected to gate of a second PMOS transistor; and a sixth NMOS transistor for discharging voltage of the fifth node to ground voltage according to the voltage of the fourth node.

10. The circuit for generating internal power voltage according to claim 9, wherein the pulse generation unit further comprises:

a NAND gate for inputting an active operation signal and a delay signal of the active operation signal and for generating a pulse signal in a predetermined area;

a first inverter for inverting the output signal of the NAND gate and for outputting the result to a sixth node connected to the gate of the third NMOS transistor; and a second inverter for inverting the signal of the sixth node and for outputting the result to a seventh node connected to the gate of the third PMOS transistor.

11. The circuit for generating internal power voltage according to claim 3, wherein the pulse generation unit further comprises:

a NAND gate for inputting an active operation signal and a delay signal of the active operation signal and for generating a pulse signal;

a first inverter for inverting the output signal of the NAND gate and for outputting the result to a sixth node connected to the gate of the third NMOS transistor; and a second inverter for inverting the signal of the sixth node and for outputting the result to a seventh node connected to the gate of the third PMOS transistor.

* * * * *